US005347955A

United States Patent [19]

Wittchow

[11] Patent Number: 5,347,955

[45] Date of Patent: Sep. 20, 1994

[54] STEAM GENERATOR

[75] Inventor: Eberhard Wittchow, Erlangen, Fed. Rep. of Germany

[73] Assignee: Siemens Aktiengesellschaft, Munich, Fed. Rep. of Germany

[21] Appl. No.: 129,979

[22] Filed: Sep. 30, 1993

[30] Foreign Application Priority Data

Sep. 30, 1992 [DE] Fed. Rep. of Germany ..... 4232880

[51] Int. Cl.[5] ..... F22B 37/00

[52] U.S. Cl. ..... 122/6 A; 122/235.12; 122/235.23; 122/367.1; 122/367.3

[58] Field of Search ..... 122/6 A, 235.12, 367.1, 122/367.2, 235.23, 18, 14

[56] References Cited

U.S. PATENT DOCUMENTS

| | | | |
|---|---|---|---|
| 3,665,893 | 5/1972 | Barberton et al. | 122/6 A |
| 4,726,323 | 2/1988 | Rees | 122/6 A |
| 4,782,793 | 11/1988 | Salem | 122/6 A |
| 4,864,973 | 9/1989 | Lieb et al. | 122/510 |
| 4,987,862 | 1/1991 | Wittchow et al. | 122/6 A |

*Primary Examiner*—Edward G. Favors

*Attorney, Agent, or Firm*—Herbert L. Lerner; Laurence A. Greenberg

[57] ABSTRACT

A fossil-fueled steam generator includes a vertical gas flue having a lower region being near a flame location, a region above the lower region being remote from the flame location, and an encompassing wall with tubes through which a medium can flow. The tubes are gas-tightly connected together in the lower region, and the tubes are disposed next to one another defining gaps between the tubes in the region above the lower region.

9 Claims, 2 Drawing Sheets

STEAM GENERATOR

BACKGROUND OF THE INVENTION

FIELD OF THE INVENTION

The invention relates to a fossil-fueled steam generator with a vertical gas flue or draft, including an encompassing wall having tubes through which a medium can flow.

The encompassing wall, which typically forms an evaporator heating surface of a steam generator, is often exposed to variably strong heating from one heating element to another. In the lower region near the flame, in which a number of burners for a fossil fuel are disposed, the heating is usually substantially stronger than in the region above it, which is far from the flame. The reason therefor is also that in the region far from the flame, additional exchanger surfaces are often provided, which shield the encompassing wall against overly intensive heating, especially from heat radiation.

The tubes of the encompassing wall through which the medium flows from bottom to top in parallel are welded together on their long sides, to form a gas-tight tube wall typically extending over the entire vertical length of the gas flue. The tube wall is constructed either as a tube-rib-tube structure, with longitudinal plates secured to the tubes, or as a finned tube structure, with fins formed onto the tubes.

One possibility for reducing fuel consumption and therefore also for reducing carbon dioxide emissions from a fossil-fueled steam plant is to increase the steam pressure at an outlet from the steam generator from approximately 250 bar, as before, to 300 bar, for instance. However, the steam temperature also rises in the evaporator region of the steam generator along with the steam pressure, so that it is no longer possible, as was previously usual, to use materials with a low chromium content, which are distinguished by ease of processing. A further difficulty is that because of variously strong heating of the tubes within a cross-sectional plane of the encompassing wall, the evaporation point in the tubes, that is the transition from the liquid to the gaseous state, is located at different points in the flow direction of the medium. As a result, considerable temperature differences can arise between adjacent tubes and therefore there can be differing thermal expansions of the tubes. That in turn can lead to the formation of cracks inside the tube wall.

In order to avoid operation-dictated damage to the tube wall yet nevertheless to attain a fresh steam state that is especially favorable for low coal consumption and low carbon dioxide emissions, for instance with a steam pressure of 300 bar and a steam temperature of 600° C., the use of materials with a high chromium content has already been proposed. However, manufacturing a gas-tight tube wall from such a material must be performed especially carefully and is therefore expensive, especially since an additional heat treatment after welding of the tubes is required. Moreover, long down times are needed for inspection or operation-dictated repairs. That in turn has a deleterious effect on the availability of the steam generator and therefore on the plant availability of the entire steam power plant.

SUMMARY OF THE INVENTION

It is accordingly an object of the invention to provide a steam generator, which overcomes the hereinaforementioned disadvantages of the heretofore-known devices of this general type and which does so in such a way that a fresh steam state with a high steam pressure is attainable at simultaneously low industrial effort and expense and with high availability.

With the foregoing and other objects in view there is provided, in accordance with the invention, a fossil-fueled steam generator, comprising a vertical gas flue including a lower region being near a flame location, a region above the lower region being remote from the flame location, and an encompassing wall having tubes through which a medium can flow; the tubes being gas-tightly connected together in the lower region, and the tubes being disposed next to one another defining gaps between the tubes in the region above the lower region.

In the lower region near the flame, in which the medium flowing through the tubes is substantially water, the temperature difference between adjacent tubes is less than in the region remote from the flame which is located above it, in which the medium flowing through the tubes is substantially steam. Especially at the outlet from the evaporator and in the region of the transition from water to steam, the temperature differences between the tubes may become especially great and in particular may be harmful.

In accordance with another feature of the invention, the transition from the lower gas-tight to the upper gap-forming configuration of the tubes is suitably located at the level of the transition of the medium from the liquid to the gaseous state. The criterion for defining the boundary between the gas-tight and the gap-forming configuration may be the transition from water to steam or to a water-steam mixture, for example, in terms of the medium.

In accordance with a further feature of the invention, since a tube wall thickness of approximately 8 mm is authorized in the uppermost part of the vertical gas flue in which practically no flame or gas radiation prevails, the tubes in this region located above the gap-forming configuration may again be joined together in gas-tight fashion. A tube wall material having a low chromium content may also be used in this region.

The tubes of the tube wall or encompassing wall, may be constructed as finned tubes or as tubes with fins. In accordance with an added feature of the invention, particularly in the region remote from the flame, in which the tubes are disposed next to one another forming gaps, the tubes have integral or welded-on, finlike longitudinal plates on their long sides.

In accordance with an additional feature of the invention, the tubes of the encompassing wall suitably extend vertically both in the region near the flame and in the region far from the flame. However, especially in the region near the flame, they may also be constructed in such a way as to extend spirally.

In accordance with a concomitant feature of the invention, in order to attain adequate gas tightness of the encompassing wall over the entire vertical length of the gas flue, a seal, such as a metal plate, is provided on the outside of the encompassing wall in the region of the tubes being disposed next to one another and forming gaps.

The advantages attained with the invention are in particular that a steam generator with a vertical gas flue, having an encompassing wall that is formed partly of tubes being joined together in gas-tight fashion and partly of tubes being disposed next to one another and forming gaps, can be produced especially economically. Moreover, since the down times for repair work are especially short, its availability is especially high, in fact precisely in the region where the likelihood of malfunction is especially high because of specially severe thermal strain, because there the individual tubes are not joined together and thus are replaceable in a simple way either completely or in segments. Moreover, fresh steam states with especially high steam pressures and steam temperatures scan be attained.

Other features which are considered as characteristic for the invention are set forth in the appended claims.

Although the invention is illustrated and described herein as embodied in a steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
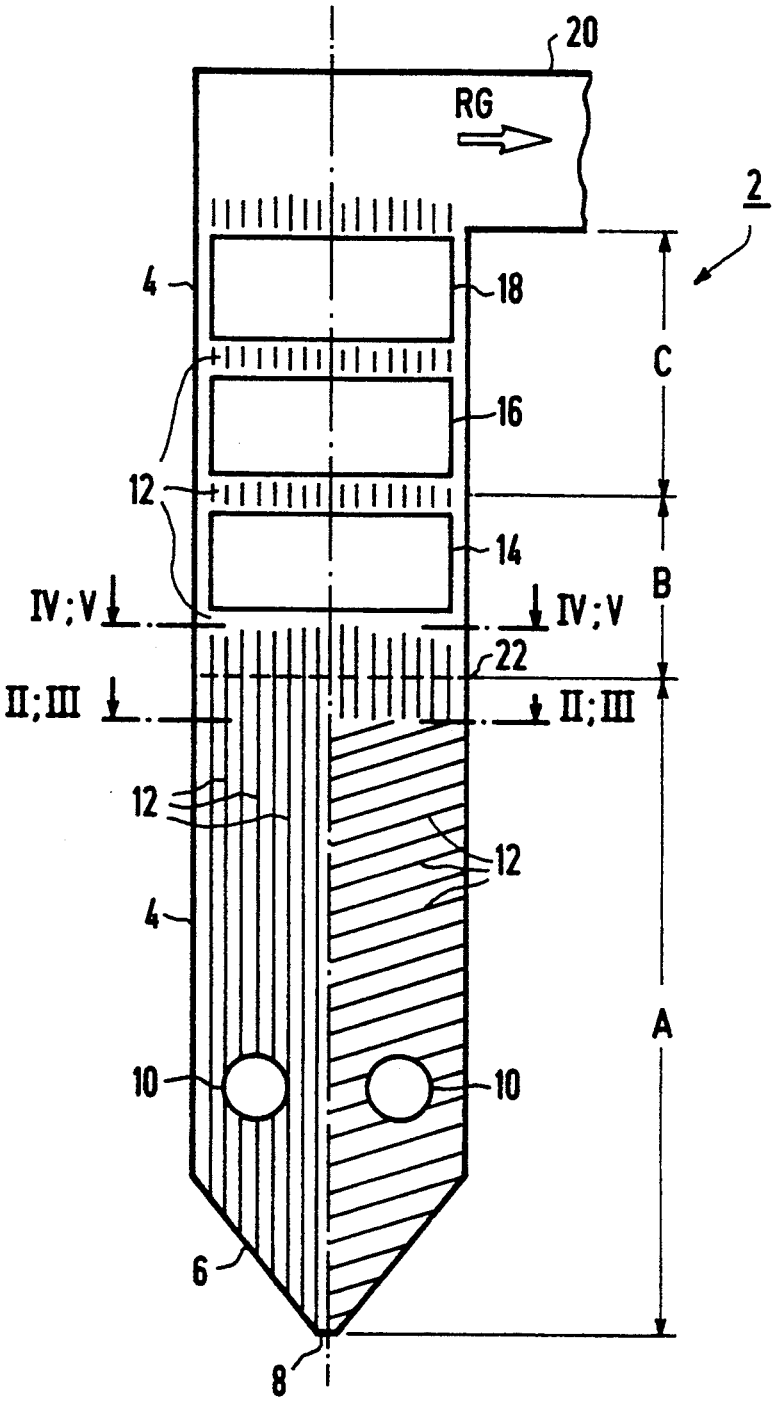
FIG. 1 is a simplified, fragmentary, diagrammatic elevational view of a steam generator with a vertical gas flue subdivided into three segments.

Referring now in detail to the figures of the drawing, in which elements that correspond to one another are provided with the same reference numerals, and first, particularly, to FIG. 1 thereof, there is seen a vertical gas flue or draft of a steam generator 2 having a rectangular cross section, which is formed by an encompassing wall 4 with a transition into a funnel-shaped bottom 6 at a lower end of the gas flue. The bottom 6 encompasses a discharge opening 8 which is used for ashes but is not shown in detail.

In a first lower region A of the gas flue, a number of burners for a fossil fuel are each mounted in one respective opening 10, only two of which are visible. The openings 10 are formed in the encompassing wall 4 which is formed of tubes 12. In this region A, the tubes 12 may either be disposed vertically or they may extend spirally as is respectively shown at the left and right sides of FIG. 1.

Located above the lower region A of the gas flue is a second region B of the gas flue, that is remote from the flame, and above which a third, upper region C of the gas flue is provided. In the regions B and C of the gas flue, in which convection heating surfaces 14, 16 and 18 are also disposed, the tubes 12 extend vertically. Located above the region C of the gas flue is a flue gas outlet channel 20, by way of which flue gas RG produced in the combustion of a fossil fuel leaves the vertical gas flue.

The lower region A near the flame is distinguished by a very high heat flow density and good internal heat transfer into the tubes 12. In this region A, the tube wall thickness is 6.3 mm at maximum. The region B which is remote from the flame and which is located in the so-called gas jet space, is likewise distinguished by a high heat flow density, but also by a lesser, poorer internal heat transfer into the tubes 12. The upper region C, that is likewise remote from the flame and is also known as a convection flue or draft, is distinguished by a low heat flow density and a moderate internal heat transfer into the tubes 12. In this region C, the maximum tube wall thickness is allowed to be 8 mm.

During operation of the steam generator 2, the medium flowing in the tubes 12 is in the liquid or gaseous state, depending on the region, A, B or C. While the medium flowing inside the tubes 12 is substantially water, at least in the great majority of the region A which forms the evaporator heating surface of the steam generator 2, in the region B the medium is substantially in the form of a mixture of water and water vapor, or is already in the form of steam. In an intermediate region 22 between the regions A and B, in which an evaporator outlet is suitably located, a transition from the liquid to the gaseous state takes place. In this intermediate region 22, the operation-dictated temperature differences between adjacent tubes are often especially great, particularly at high steam pressures and steam temperatures. By comparison, the temperature differences between the tubes 12 of the region A through which water flows, and the tubes 12 of the region B through which essentially steam flows, are relatively small. The temperature differences between the tubes 12 of the region B are greater than between those of the region A.

Figure 2:
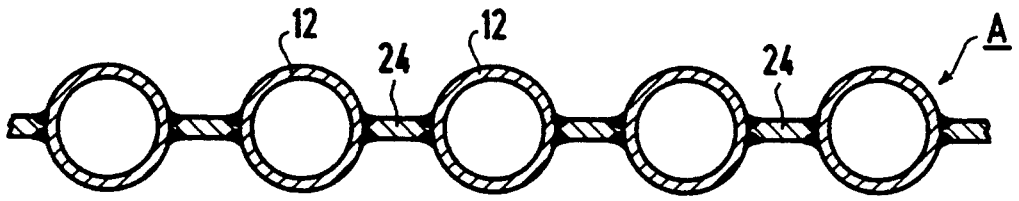
FIGS. 2 and 3 are fragmentary, cross-sectional views of a gas-tight tube wall having tubes with fins or with finned tubes.
Figure 3:
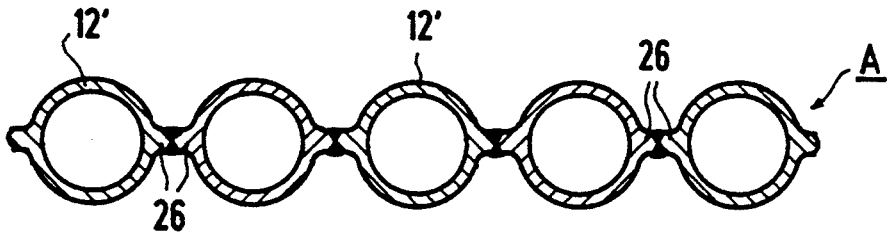
Figure 4:
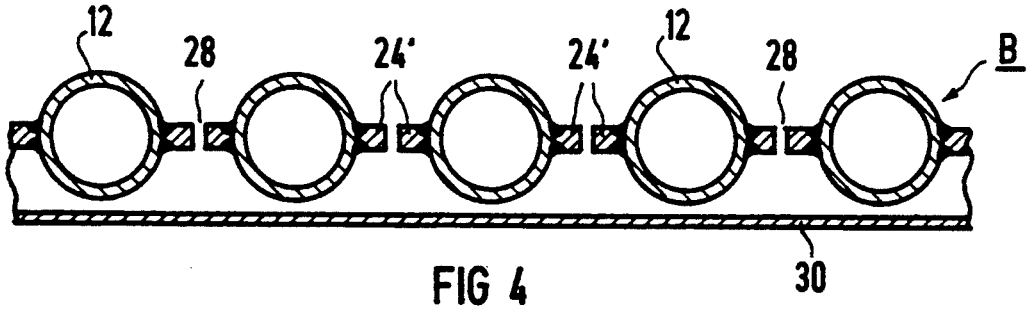
FIGS. 4 and 5 are fragmentary, cross-sectional views of a tube wall having tubes with fins or finned tubes disposed next to one another, forming gaps.
Figure 5:
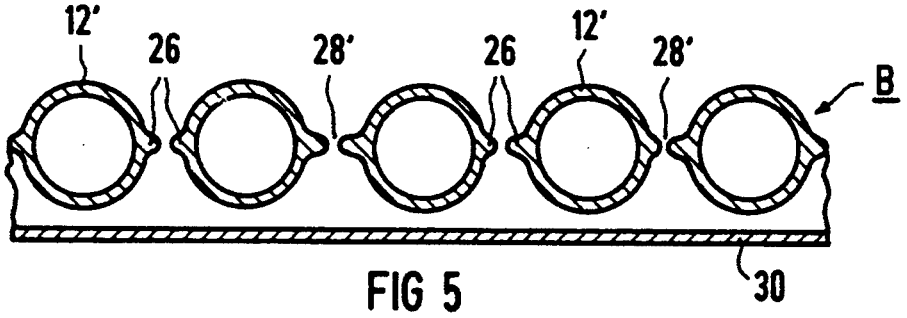

The tubes 12 are therefore joined together in gas-tight fashion in the lower region A near the flame, as is shown in FIGS. 2 and 3, while in the region B above it, remote from the flame, they are disposed next to one another forming gaps therebetween, as is shown in FIGS. 4 and 5. To that end, as is shown in FIG. 2, longitudinal plates 24 are welded longitudinally between adjacent tubes 12. This mode of construction is also known as tube-rib-tube construction. Alternatively, so-called finned tubes 12' with formed-on fins 26 may be used, as is shown in FIG. 3. The fins 26 are welded together on their long sides. This mode of construction is also known as finned tube construction.

In the region B, as is shown in FIG. 4, the tubes 12 are provided with longitudinal plates 24' and are disposed next to one another, forming one respective gap 28 between each two adjacent tubes 12. Two longitudinal plates 24' are welded to each respective tube 12 forming fins. Such tubes 12 are therefore also called tubes with fins. Alternatively, as is seen in FIG. 5, finned tubes 12' can also be used in this region B, which are then likewise disposed next to one another, forming gaps 28'. In this region B, in which the tubes that are constructed as tubes 12 with fins or as finned tubes 12' are disposed next to one another forming gaps, a seal 30, which may be a metal plate, is provided on the outside of the encompassing wall 4. This assures adequate gas tightness of the vertical gas flue with respect to its surroundings in this region B as well.

In the upper region C, the tubes 12 are again suitably joined to one another in a gas-tight fashion. There, they again form a gas-tight tube wall, either in the form of a tube-rib-tube construction as is shown in FIG. 2 or as a finned tube construction as in FIG. 3.

I claim:

1. A fossil-fueled steam generator, comprising:

a vertical gas flue including a lower region being near a flame location, a region above said lower region being remote from the flame location, and an encompassing wall having tubes through which a medium can flow;

said tubes being gas-tightly connected together in said lower region, and said tubes being disposed next to one another defining gaps between said tubes in said region above said lower region.

2. The steam generator according to claim 1, including a transition from said lower gas-tight tube region to said gap-forming tube region above said lower region, said transition being disposed in a region at a transition from a liquid to a gaseous state, in terms of the medium.

3. The steam generator according to claim 1, wherein said gas flue has a region above said gap-forming tube region above said lower region, in which said tubes are gas-tightly connected together.

4. The steam generator according to claim 1, wherein said tubes have long sides and finlike longitudinal plates on said long sides.

5. The steam generator according to claim 1, wherein said tubes of said encompassing wall extend in a spiral in said region near the flame location and extend vertically in said region remote from the flame location.

6. The steam generator according to claim 3, wherein said tubes of said encompassing wall extend in a spiral in said region near the flame location and extend vertically in said region remote from the flame location and in said region above said region remote from the flame location.

7. The steam generator according to claim 1, wherein said tubes of said encompassing wall extend vertically both in said region near the flame location and in said region remote from the flame location.

8. The steam generator according to claim 3, wherein said tubes of said encompassing wall extend vertically in said region near the flame location, in said region remote from the flame location and in said region above said region remote from the flame location.

9. The steam generator according to claim 1, including a seal disposed on the outside of said encompassing wall in said region in which said tubes are disposed next to one another defining the gaps between said tubes.

* * * * *